United States Patent [19]

Jonsson

[11] 4,052,014

[45] Oct. 4, 1977

[54] ARRANGEMENT IN MILL DRUMS PROVIDED WITH WEAR PROTECTIVE LININGS

[75] Inventor: Erik Alfon Jonsson, Boliden, Sweden

[73] Assignee: Boliden Aktiebolag, Stockholm, Sweden

[21] Appl. No.: 663,765

[22] Filed: Mar. 4, 1976

[30] Foreign Application Priority Data

Mar. 7, 1975 Sweden ..... 7502606

[51] Int. Cl.[2] ..... B02C 17/22

[52] U.S. Cl. ..... 241/183; 241/299

[58] Field of Search ..... 241/181, 182, 183, 284, 241/299

[56] References Cited

U.S. PATENT DOCUMENTS

| | | | |
|---|---|---|---|
| 2,476,505 | 7/1949 | McIntyre | 241/299 X |
| 3,107,867 | 10/1963 | Svensson et al. | 241/183 X |
| 3,378,209 | 4/1968 | Crocheron | 241/182 X |
| 3,462,090 | 8/1969 | Landes et al. | 241/299 |

FOREIGN PATENT DOCUMENTS

| | | | |
|---|---|---|---|
| 2,010,630 | 11/1971 | Germany | 241/182 |
| 2,112,889 | 9/1972 | Germany | 241/183 |
| 354,196 | 3/1973 | Sweden | 241/182 |
| 7,402,611 | 2/1974 | Sweden | 241/183 |

*Primary Examiner*—Roy Lake
*Assistant Examiner*—Howard N. Goldberg
*Attorney, Agent, or Firm*—Stevens, Davis, Miller & Mosher

[57] ABSTRACT

In a mill drum provided with wear protective linings and ore lifting and carrying means in the form of longitudinal wings comprising an elastomeric material and extending radially inwardly from the lining of the mill drum an arrangement for securely attaching the wings to the walls of said mill drum, comprising at least two contiguous anchoring rods extending in the longitudinal direction of the bases of the wings through longitudinal holes made through the material of the wings, said anchoring rods passing through yoke means, which are recessed in the bases of the wings at a desired pitch or distribution along said bases and being connected to means for pressing the complete wing units against the drum of the mill and for retaining said wings in their mounted position.

18 Claims, 8 Drawing Figures

ARRANGEMENT IN MILL DRUMS PROVIDED WITH WEAR PROTECTIVE LININGS

The present invention relates to an arrangement in mill drums provided with wear protective linings and ore lifting and carrying means, said means having the form of wings comprising an elastomeric material and extending radially inwardly from the lining of the mill drum, each of said wings being anchored to the wall of the mill drum by means of securing means which at any desired pitch along the said wings penetrate into the material of the base of the wings, wherein they are retained by anchoring means extending in the longitudinal direction of the bases of the wings.

The wear protective linings of mill drums for the grinding of ores and similar materials were previously predominently made of metal, metal alloys etc. Gradally, however, the composition of such linings has changed from a primarily metallic nature to an elastomeric nature, such as linings made chiefly of rubber and synthetic resins of varying hardness and elasticity. In order to increase the capacity of such mill drums, i.e. the throughput or the quantity of material ground per unit of time, such mill drums are now frequently provided with elongate projections ususally in the form of wings which extend from the lining radially in toward the centre of the mill drum and which are arranged upon rotation of the drum to lift the ore to a certain height above the bottom of the drum and to cause said ore to fall continuously onto said bottom.

Mill drums hitherto known for this purpose have relatively moderate dimensions especially with respect to their diameter. Furtherore, because, inter alia, the wings are placed under considerable stress as a result of the torque to which they are subjected as they carry and lift the ore during rotation of the drum, and because of the strain to which the devices securing the wings to the drum are subjected, it has been necessary to limit the extension of the wings beyond the lateral lining plates to a radial dimension which, expressed in general terms, is substantially the thickness of said lining plates, i.e. in practice 40–100 mm.

For the securing of wings of such relatively small dimensions, different securing devices have been used or suggested, these devices resisting the strains to which they are subjected for a limited operating period which corresponds at least to the time taken to almost completely wear down the wings of relatively small radial dimensions which have hitherto been in use. In attempts to increase the diameter of the mill drum to the dimensions which are required for autogenous grinding e.g. in accordance with U.S. Pat. No. 3,924,814 while increasing the wing-height above the lateral lining plates to some extent and maintaining known securing devices, it very soon proved that the wings were completely loosened or displaced out of their securing positions, whereby moisture and grinding materials penetrated between the mill drum or jacket itself and the lifters. In the case of securing devices which were not completely worn down or loosened, the deformation of such devices contributed to considerable difficulties with respect to their replacement. In addition, the wear protective plates placed between the wings had to be replaced after an unacceptable short operating period depending on the optimum demands on the ratio between said radial extension of the lifters and the plates, respectively.

Amongst the extremely few previously known securing devices which offered accpetable operating qualities in mill drums of the small dimension types discussed above, the arrangement constituting the subject of the U.S. Pat. No. 3,107,867 may be mentioned.

In this arrangement there is an anchoring or securing device in the form of a rail loosely inserted in a prepared longitudinal T-shaped slot in the base of the wing, which rail is anchored to the wall of the mill drum by means of anchoring bolts which are either welded to or screwed into the rail.

If by using such an anchoring device the radial extension of the wing is raised over the maximum 100 mm discussed above and if soft resilient material is used for the lining, whether it be a question of mills of small diameter or large diameter as in autogenous grinding, it has been found that the lifters loosen completely from their securing means after an excessively short operating period. This is due either to the fact that the lifters have slid off the rail or that the rail has sheared off that part of the material of the wing which is situated under the rail and which is subjected to pressure stains from the grinding materials. If on the other hand harder elastic qualities are used trying to counteract these inconveniences the wearing, down of the lining, including the wings will instead be increased disproportionately.

The object of the present invention is consequently to remedy said inconveniences by providing an arrangement for retaining lifters in mill drums of varying kinds, especially those for autogenous and semi-autogenous grinding of comparatively coarse materials, having a considerable drum diameter, preferably exceeding 5 mm and a ratio between the height of the lifter beyond the lateral wear protective lining and the thickness of said lifter exceeding 1.0.

In accordance herewith the invention is mainly characterized in that the securing means at the parts thereof penetrating into the material of the said bases carry yoke means recessed transversely to the longitudinal direction of the wings, in the material of the wings, said yoke means presenting at least one hole in each of their shanks for receiving each one anchoring means respectively.

So that the invention will be more readily understood and further features they make apparent, embodiments will now be described with reference to the accompanying drawing, in which FIG. 1 is a sectional view of a portion of a mill drum provided with a wear protective coating in accordance with the invention;

FIG. 2, is a view along the surface of its longitudinal edge, the root or base end of a wing of elastomeric material serving as a lifting means for ore or the like to be ground in the mill drum, as well as coordinated short retaining rails fitted with yoke means in a separate view;

Figure 1:
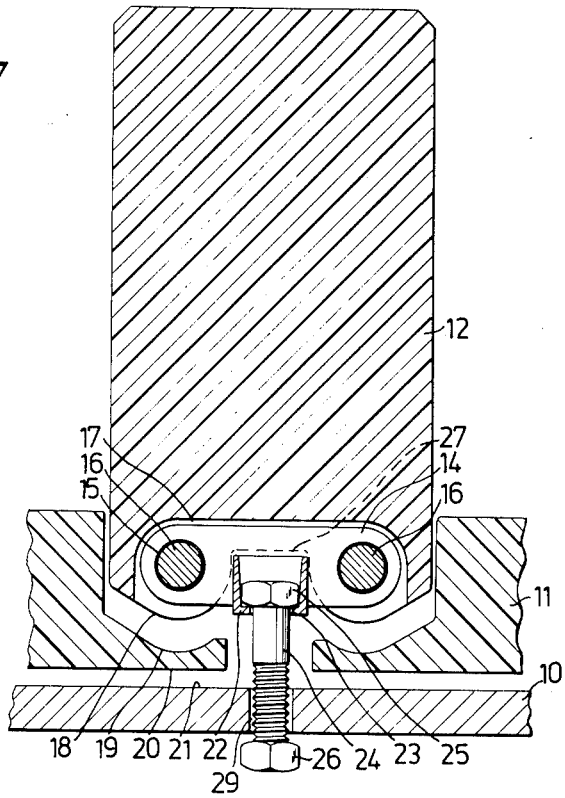

Referring firstly to FIG. 1 of the drawing, reference numeral 10 designates either a peripheral portion of a mill drum or the end-wall thereof lined for autogenous or semiautogeneous grinding in accordance with the invention. Reference numeral 11 designates two adjacent plates in the protective lining of the mill drum, which plates rest against the cylindrical wall or end wall. Reference number 12 designates a wing which comprises an elastomeric or resilient material and which extends radially inwardly from the lining of the mill drum. The plates can be made of any material suitable or preferred for the purpose e.g. a metallic and/or elastomeric material. The plates 11 and the wings 12 alternately cover the inner surface of the mill drum and together actually constitute the lining of the mill drum.

Figure 3:
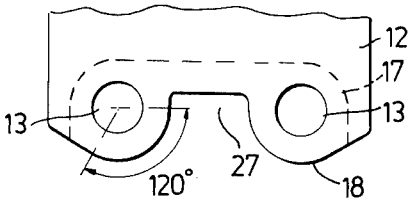
FIG. 3 is a side view of the root or base end of the wing in accordance with FIG. 1 or FIG. 2.

In FIG. 3, reference numeral 13 designates two substantially parallel holes made in the longitudinal direction through the root or base of the wing, intended to receive and accommodate anchoring rods inserted in them. These rod holes can, in accordance with the invention, either be produced by mechanical processing of the wings or by a moulding process in the original manufacturing of the wings and/or by plastic deformation of wing blanks. Reference numeral 14 designates e.g. in FIG. 1 one of a number of yoke means which are characteristic of the invention, said yoke means being directed transversely to the longitudinal direction of the wings and accommodated in the root or base of the wings. Each yoke means 14 is provided with at least two symmetrically arranged rod holes, designated by 15, the distance between which is selected such that said holes in the assembled position illustrated in FIG. 1 coincide with the rod holes 13 (FIG. 3) in the base of the wing. Reference numeral 16 in the example shown in FIG. 1 designates two oblong anchorage rods inserted or forced into the holes 13, which rods also penetrate each one of the rod holes 15 in both of the arms or shanks of all of the yoke means 14. Although FIG. 3, shows a wing having a base which is penetrated longitudinal by only two rod holes 13, the number of rod holes in accordance with the invention can, however, be greater depending on specific design requirements. Characteristic of all variants or modifications is, however, that the number of rod holes 13 in the base or attachment part of each wing 12 corresponds with the number of rod holes 15 in each yoke means 14 so that the various rod holes coincide with each other in order to enable the corresponding anchorage rods to pass through at least certain ones of all the rod holes.

Reference numeral 17 in FIGS. 1, 2, 3 and 8 designates narrow transverse recesses made in the base of the wings to receive and accommodate the yoke means 14. The recesses 17 extend inwards in the material of the wings from the limiting surface of the longitudinal edge in the retaining or base part of the wing and penetrate the walls of the rod holes 13 at a desired, preferably even pitch, along the wing and allow the yoke means 14 to be inserted in their correct position in the base of the wing so that their rod holes 15 coincide with the rod holes 13 of the base of the wing. Thus, in the base of each wing there is entered and accommodated in position a predetermined nuber of yoke means 14 after which the anchorage rods 16 are inserted through all of the rod holes 13 and 15.

Reference numeral 18 in FIGS. 1 and 3 designates curved surfaces of the longitudinal edge on the base of the wing 12 shown, while reference numeral 19 designates conform support surfaces made in adjacent wear protective plates adapted, when assembled, to be pressed together with the curved surfaces 18. In the embodiment shown the mutually adjacent longitudinal edges of the plates 11 are shaped with each one groove-like support surface 19 serving as a socket for the curved surface of the longitudinal edges 18 of the wings. As a consequence of the groove-like shape of the support surfaces and due to the fact that the opposing surfaces 18 and 19 are complementary and preferably being curved slightly or gently as viewed in section, a close configuration engagement between them is obtained when the wing in a final assembly phase is anchored to the wall of the mill drum 10 by being tightened against it. The invention is, however, not limited to this particular way of attaching the wing. Thus, the surface of the longitudinal edge in the base of the wings could alternatively be flat and pressed against flat support surfaces on the plates. In accordance with another alternative the wings could be provided with a relatively flat surface of the longitudinal edge of the base and with this surface be pressed directly against the inner wall or end surface of the drum 10 whereby the protective plates 11 only then lie against the sides of the wing 12. Reference numeral 20 in the first example above designates the surface of a protective plate 11 to be brought against a surface 21 in that part of the inner surface of the mill drum which the lining is to protect.

As will be more closely evident from FIGS. 1, 2 and 3 there extends centrally into the material in the base of a wing from the surface of its longitudinal edge a longiudinal groove or channel 27 which penetrates the transverse side walls of all of the recesses 17 in said base.

This groove 27 is adapted to receive at least one longitudinal retaining rail 22 for the yoke means 14 accommodated in the recesses 17. The yoke means 14 are attached to the said retaining rail in an appropriate way, for example by welds, as is more clearly elucidated in the cross section of a retaining rail 22 shown in FIG. 5.

Figure 8:
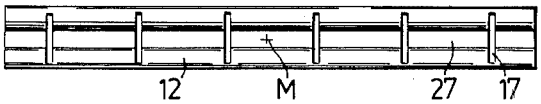
FIG. 8 shows the root or base of a somewhat modified wing in an end view towards the surface of its longitudinal edge, provided with recesses for accommodating yoke means, shaped and located in accordance with FIG. 7.
Figure 7:
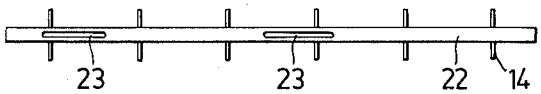
FIG. 7 is a modified embodiment of the retaining rail with yoke means in a plan view.
Figure 9:
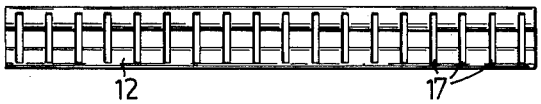

FIG. 7 illustrates an embodiment in which a single, viz. a continuous longitudinal retaining rail 22 is utilized which without any interruption has a length which substantially corresponds to the length of the corresponding wing 12 in accordance with FIG. 8. As is further apparent from FIG. 7 the yoke means 14 are attached to the retaining rail 22 with a relatively large pitch which, as is clearly evident, is intended to agree with the corresponding pitch of the open recesses 17 shown in FIG. 8, in which the yoke means 14 are to be accommodated when assembling in accordance with FIG. 7, the retaining rail 22 in the base of the wing in accordance with the said FIG. 8.

Figure 4:
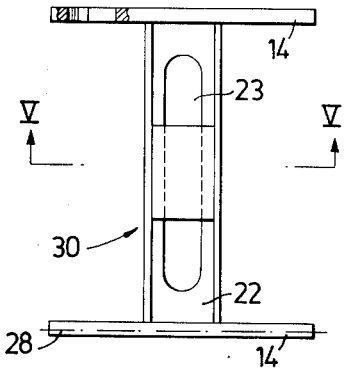
FIG. 4 is a plane view of two mutually adjcent yoke means attached to a short longitudinal retaining and spacer rail.
Figure 5:
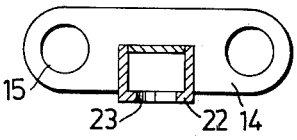
FIG. 5 is a cross-section of the retaining and spacer rail with yoke means in accordance with FIGS. 1, 2 or 4.

The retaining rails indicated above and generally designated by reference numeral 22 in both of the length variants which are represented in general by FIGS. 1 and 7 and by FIGS. 2, 4 and 5, respectively, present a section which is U-shaped in a cross-sectional view and preferably made of metallic material, to which the yoke means 14 in accordance with the above are attached by welding or by some other means in order to maintain a predetermined pitch or mutual distance between two adjacent yoke means 14 on short separate lengths of rail respectively wherein a continuous longitudinally running retaining rail in certain cases, such as in FIG. 2, can be divided. The pitch and the distance between the yoke means 14, respectively, is selected in accordance with the invention similarly to the pitch of the recesses 17 in the base of the wing according to desire, whereby it must of course be ascertained that the pitch and spacing respectively correspond so accurately that the yoke means 14 can be conveniently accommodated in the recesses 17 to take their correct positions therein.

In FIGS. 2 and 8 said recesses 17 are shown, in accordance with a preferred case, to be mutually coordinated with an even pitch along the base of the wing whereby it has also been ascertained that the recesses on the left and right of the wing are arranged symmetrically with respect to the central point M of the base (see FIG. 8).

This arrangement is to be preferred since the wing subsequent to being worn down on its attack side in the mill drum can thereby easily be reversed in such a way that the place of the previous attack side can thereafter be taken by the previous rear side of the wing. This involves an advantageous economic use of the material of the wing and consequently a considerably prolonged total durability of the wing. In using the wing in such a way two cases are conceivable namely on the one hand to reverse the wing itself in relation to the retaining rail or retaining rails 22, respectively, with attacked yoke means 14 or to reverse both the wings and retaining rails in unison.

Although the pitch discussed above is preferably selected to be even, design considerations could require that alternative pitch principles be applied in special cases. Such design alternatives lie completely within the scope of the invention which allows a completely arbitrary pitch for both recesses and corresponding yoke means. The invention even embraces a mixed pitch principle, viz. an even pitch alternating with a pitch deviating therefrom, e.g. so that the yoke means with the corresponding recesses are arranged more closely in those wing zones which are expected to be subjected to extreme loads or strains.

Common to all pitch alternatives, however, is that the recesses 17 must always be of such depth, breadth and length that the yoke means 14 can be completely accommodated therein, entailing that the recesses 17 penetrate the longitudinal walls around the rod holes 13 (FIG. 3) in the base of the wing 12.

The U-shaped section retaining rail 22 described above with reference to FIGS. 1, 4, 5 and 7 has along its length a number of through-holes 23 made at the desired pitch in the web, through which anchorage bolts 24 are threaded for anchoring of the entire wing unit to the wall of the mill drum 10. These bolt holes 23 can for example in FIG. 1 in the simplest case be circular and with a little play match the cross-section of the bolt shaft and be arranged at a pitch along the rail which ought to correspond relatively accurately with the pitch for a corresponding number of circular through-holes 29 for the bolts 24 in the wall of the drum 10. As is also apparent from FIG. 1 the shafts of the bolts 24 with threaded ends extend some distance beyond the wall of the drum 10, on which ends are threaded anchorage nuts 26. These nuts which in FIG. 1 are shown only lightly screwed onto their respective bolts 24, are adapted to be threaded still further upon the final anchoring of the wing 12 in the mill drum 10. When the threading of the nuts is complete a holding position has finally been reached wherein the protective plates 11 press their surfaces 20 against the inner surface 21 of the mill drum 10 at the same time as the surface 18 of the longitudinal edge of the wing 12 press against the opposing suppport surfaces 19 of the protective plates. By thereafter tightening the bolts 26 still further against the external side of the wall of the drum 10 such tension can be brought about in all of the bolts which is required for anchoring the wing 12 as well as the protective plates 11 to the wall of the drum 10 with good security.

As is further evident from FIG. 1 the heads 25 of the bolts 24 rest against the web of the retaining rail 22 on the inside of said rail. furthermore, the shape and dimensions of the bolt head 25 are adapted to the inner distance between the two flanges of the retaining rail 22 so that the said heads 25 and thereby the bolts 24 are prevented from turning during tightening of the bolts 26.

Although the retaining walls of the type described above with circular bolt holes arranged at a preferred pitch along the retaining rail 22 and corresponding to the opposing circlar bolt holes 29 in the wall of the mill drum 10 are in many cases satisfactory e.g. with relatively short wings, it has often turned out that difficulties arise in fitting the bolts 24 into the bolt holes 29 normally made in advance in the mill drum and which do not always correspond to the placing or pitch of the bolt holes 23 in the retaining rail 22. As a remedy for such an inconvenience it also lies within the scope of the invention to make the bolt holes 23 oblong in the various modifications of the retaining rails as is illustrated in FIGS. 2, 4 and 7. This offers the advantage namely that bolts threaded through such oblong holes 23 can be freely adjusted in these holes in the longitudinal direction of the retaining rails which in addition also renders possible relative displacement of the retaining rails 22 in the longitudinal direction in the fitting of the yoke means 14 into the recesses 17. At the same time the arrangement can, of course, in accordance with the above, in order to prevent the turning of the bolts 24 in the tightening of the nuts 26 also be used with oblong bolt holes 23.

To explain the purpose of the unit consisting of a short retaining rail 22 with two yoke means attached thereto as illustrated in FIGS. 4 and 5 and to which general reference has been made above it may be observed that a number of such separate units or elements 30 are intended, as is shown in FIG. 2, together to replace the previously mentioned unit having a single retaining rail which extends intact along the entire length of the wing and supports a number of yoke means 14 attached thereto at a predetermined pitch which are accommodated in certain ones of the corresponding recesses 17 in the base of the wing 12. It may also be added that such short retaining rails are suitably provided with at least one oblong bolt hole 23 in accordance with the above.

When attaching a wing in a mill drum in accordance with FIG. 2 there is thus inserted a number of short separate units or elements 30 consisting of two yoke means and a spacer retaining rail 22 located between them, into the recesses 17 made for the purpose in the base of the wing 12. The number of such units or elements 30 which are accommodated in the groove 27 is selected with regard to the expected stresses on the wings during operation of the mill. The short spacer rails 22 will thereby be received in the longitudinal groove 27 in the base of the wing as indicated in FIG. 2. It is also possible here to adjust arbitrarily an anchorage bolt 24 in the longitudinal direction of the groove along the entire length of the oblong bolt hole 23 made in the retaining rail. By a suitable choise of the pitch or the distance between the recesses 17 and the distance between the centre planes 28 of the yoke means and the length of the hole 23 in the spacer retaining rail it is possible with a few construction units or elements to manufacture in advance the wing, retaining rails as well as the yoke means and at the same time obain a good fit with the bolt holes 28 existing in the circular mill wall and/or ends for the insertion of the bolts, which holes may be arranged at an arbitrary pitch. In order to achieve optimal flexibility in the building of the units 30 the distances between the transverse recesses 17 in the surface of the longitudinal edge of the wing 17 are preferably chosen according to the principle of even pitch and the length of the spacer retaining the rails 22 for the yoke means 14 such that the distance between the central planes 28 of adjacent yoke means (see FIG. 4) constitutes a whole number multiple of the pitch between the transverse recesses 17, in addition to which the oblong holes 23 in the retaining rails are given a length of 0.5 - 0.8 preferably 0.55 -0.65 of the distance between the centre planes 28 of adjacent yoke means 14.

Figure 6:
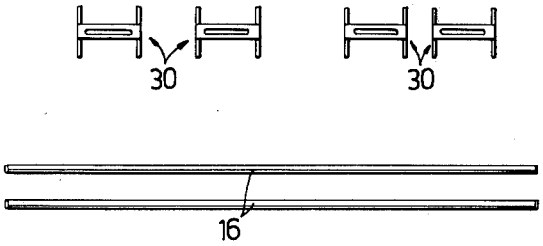
FIG. 6 shows two solid anchoring rods adapted to be passed or forced through corresponding rod holes in the wings and the yoke means.

FIG. 6 shows in a separate view the two anchorage rods 16 incorporated in FIG. 1. To facilitate insertion of the rods 16 as well as their removal from the rod holes 13 in worn wings it is suitable to use rods and yoke means of rust-proof material. In certain cases it can be of advantage to substitute tubes for the rods. Other profiled sections than round can also be used. However, it is desirable to avoid profiled sections with sharp edges which could tear the material of the wings. In addtion, it can be of advantage to give the rods 16 a somewhat conical shape or at lest let taper them somewhat at least at their insertion ends in order to facilitate the insertion of the rods 16 through the rod holes 13 in the wing and in the rod holes 15 in the yoke means 14.

Concerning the embodiment in accordance with FIG. 7, this is modified in comparison with the example shown in FIG. 4 in so far as a greater number than two yoke means have been attached at an even pitch to a single intact retaining rail 22. The distance between the centre planes 28 of the yoke means is thereby chosen such that it constitutes a whole number multiple of the pitch between the recesses 17 in FIG. 2. Such a design will normally be used when the wings are relatively short.

FIG. 8 shows, as viewed towards the surface of its longitudinal edge, a base of a wing adapted for the insertion of retaining rail and yoke means shaped in accordance with FIG. 7.

The embodiments of the arrangement in accordance with the invention shown in FIGS. 1–8 embrace embodiments in which the lining of the mill drum consists of elastomeric material both as regards the plates 11 and the wings 12. The inention is of course alternatively applicable with different combinations of materials in plates and wings. The wings made of elastomeric material can have reinforcing enclosures of e.g. metallic material. The plates 11 can be made of elastomeric or metallic material or combinations of such materials. Of elastomeric materials rubber is preferred.

As indicated above it may in certain cases be desirable to have more than two parallel rod holes for anchorage rods and yoke means constructively adapted thereto.

For both rods and yoke means an acid-resistant, rust-proof material is preferably chosen, which is also preferable for the retaining rails.

The arrangement described here for the lining of mills has proved to offer special advantages in autogenous or semi-autogenous grinding. Such grinding is normally carried out in mills of large diameter. Complete protection against wear requires a very heavily dimensioned lining and the securing of this lining demands very durable devices which the present invention now offers. it is thus now possible to give wings a desired, considerable radial extension beyond the lateral plates. Normally this extension amounts to two times the width or thickness of the wing. The superior securing ability of the present anchoring device as compared with previously known devices allows that the lining can be used in mills with very great diameter and its prominant features are most advantageous when the diameter of the mill exceeds 4 meters.

The mechanical anchoring device in accordance with the invention also offers the advantage that the securing means can be reused several times even after the wings have been worn out. The arrangement with anchoring rods pressed into the base also allows that the wings can be used until they have been worn down to the base. The design also allows, as decribed above that the wings can be used after their attack side has been worn down. The linings in accordance with the invention have therefore very high reliability in operation and durability.

The invention is not limited to the embodiments of the same shown and described but can be varied in different ways within the scope of the following claims.

I claim:

1. An arrangement in mill drums having wear protective linings and ore lifting and carrying means in the form of a wing comprised of an elastomeric material and extending radially inwardly from the lining of the mill drum, said wing being secured to the wall of the mill drum by means of securing mans including a securing bolt which protrudes beyond the external surface of the wall of the drum through a corresponding bolt hole through said wall to receive a locking means for said bolt urgeable against the outside of said drum, said securing means extending into a root portion of said wing and being retained in said root portion by means of anchoring means, said securing means being surrounded by peripherally continuous wallings spaced apart along the wing, said wallings forming integral parts of the material of said root portion, said anchoring means extending in the longitudinal direction of said wing within said wallings and through said securing means, the securing means having at those parts thereof which xtend into said root portion, yoke means also secured to the wall of the drum by said securing bolt and positioned transversely to the longitudinal direction of said wing and received in spaces between said wallings in said root portion, said yoke means having apertures therein, said apertures receiving said anchoring means.

2. The arrangement of claim 1 in which the yoke means are fixed to at least one retaining rail extending in the longitudinal direction of the wing, said rail being provided with holes for the shafts of said securing bolts whereby the bolts are prevented from separating from the retaining rail in the direction of the shaft by the heads of the bolts abutting the material of the retaining rail.

3. The arrangement of claim 2 in which the retaining rail as viewed in cross-section has a beam-shaped U-profile, the shape and dimensions of the heads of the bolts being adapted to the distance between flanges of the U-profile in such way that the bolts are prevented from turning in the said bolt holes.

4. The arrangement of claim 2 in which the holes in the retaining rail are oblong and extend in the longitudinal direction of said rail to allow individual arrangement of the securing bolts in relation to the corresponding bolt holes in the wall of the drum.

5. The arrangement of claim 4 in which the oblong holes in the retaining rail have a length of 0.5 - 0.8 of the distance between the center planes of adjacent yoke means.

6. The arrangement of claim 2 in which the retaining rail is divided into a number of retaining sections, separated from each other, with at least two of the yoke means being fixed to each section.

7. The arrangement of claim 2 in which the yoke means are fixed to the retaining rail at a predetermined pitch or distribution.

8. The arrangement of claim 1 in which the anchoring means consist of straight lengths of profiled sections with a smoothly curved profile with the apertures of the yoke means being made with a substantially complementary cross-section thereto allowing relative displacement between the anchoring means and the yoke means.

9. The arrangement of claim 8 in which the anchoring means are round in transverse cross-section.

10. The arrangement of claim 1 in which the apertures in the yoke means are symmetrically arranged.

11. The arrangement of claim 1 in which there are positioned in the material of the wing in its longitudinal direction at least two substantially parallel holes for receiving said anchoring means, the center distance of the holes corresponding to the center distance between corresponding apertures of the yoke means.

12. The arrangement of claim 11 in which the yoke means are recessed in the root portion of the wing from the end edge surface thereof in the interspaces between said wallings at a predetermined distribution along said wing, said yoke means being positioned with their apertures aligned with said parallel holes for said anchoring means through said root portion.

13. The arrangement of claim 12 in which in the end edge of said root portion between said parallel holes there is a longitudinal groove receiving at least one retaining rail for said yoke means.

14. The arrangement of claim 12 in which the distribution of said interspaces is even and the length of each retaining rail is adapted such that the distance between the center planes of adjacent yoke means constitute whole number multiples of the pitch distances between said interspaces.

15. The arrangement of claim 12 in which said interspaces are arranged symmetrically in relation to the center of said end edge surface of the longitudinal edge to allow reversing of the wing after its attack side has been worn down.

16. The arrangement of claim 1 including, for securing the wing in the wear protective lining, a groove made in the lining, serving as a socket for the root portion of the wing with the bottom surface of said groove and the opposing surface of said root portion having substantially complementary cross-sections to maintain a close configurative engagement between them under the action of the securing means.

17. The arrangement of claim 16 in which the surfaces which are substantially complementary to each other in cross-section are shaped to exhibit a slight curvature.

18. The arrangement of claim 16 in which said wear protective lining is comprised of separate plates of wear resistive material which are disposed in an edge to edge relationship in the longitudinal direction of the wings and wherein said groove is formed by one longitudinally extending recess in each marginal portion of two contiguous plates of the protective lining and the remaining material of said marginal portions forms edge flanges each having one bead for retaining engagement with said wing in the assembled position.

* * * * *